US008240843B2

(12) United States Patent
Ray

(10) Patent No.: US 8,240,843 B2
(45) Date of Patent: Aug. 14, 2012

(54) MEDIA ROLL WINDER FOR DIGITAL WEB PRESS

(75) Inventor: Paul Ray, Minneapolis, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 579 days.

(21) Appl. No.: 12/404,537

(22) Filed: Mar. 16, 2009

(65) Prior Publication Data

US 2010/0230527 A1 Sep. 16, 2010

(51) Int. Cl.
*B41J 2/01* (2006.01)

(52) U.S. Cl. ..... 347/104; 347/101; 156/504

(58) Field of Classification Search ..... 347/104, 347/103, 101, 102; 156/504, 177
See application file for complete search history.

(56) References Cited

U.S. PATENT DOCUMENTS

| | | | | | |
|---|---|---|---|---|---|
| 4,401,503 | A * | 8/1983 | Hertel | 156/461 |
| 4,569,584 | A * | 2/1986 | St. John et al. | 347/116 |
| 4,827,135 | A * | 5/1989 | Hendricks et al. | 250/374 |
| 5,173,138 | A * | 12/1992 | Blauch et al. | 156/177 |
| 5,568,245 | A * | 10/1996 | Ferber et al. | 399/384 |
| 5,794,526 | A * | 8/1998 | Raney | 100/39 |
| 6,161,604 | A * | 12/2000 | Richards et al. | 156/504 |
| 2009/0122126 | A1 * | 5/2009 | Ray et al. | 347/102 |
| 2010/0045720 | A1 * | 2/2010 | Williams et al. | 347/14 |

* cited by examiner

*Primary Examiner* — Manish S Shah

(57) ABSTRACT

A dual web winder device for a web press includes a pair of drive motors and a pair of shafts. Each shaft is coupled to one of the drive motors and configured to carry a roll of web media. The shafts and drive motors are synchronized to simultaneously unwind a first roll of web media from one shaft and rewind a second roll of web media on the other shaft.

15 Claims, 11 Drawing Sheets

MEDIA ROLL WINDER FOR DIGITAL WEB PRESS

BACKGROUND

High speed printing, such as used when printing newspapers, has typically been accomplished by large offset printers. More currently printing companies have turned to digital printing equipment, such as digital web presses, to print a greater variety of data and short-run jobs such as a single book, direct mail, transactional material and a host of other applications.

Some digital web presses are configurable for use as a simplex printer that prints on one side of the web media, or as a duplex printer that prints on both sides of the web media. For example, FIG. 1 shows a digital web press system, indicated generally at 10, configured for simplex and duplex printing. The web press has two sequential thermal inkjet press sections 20 and 22, two independent dryers 30 and 32, an unwinder device 40, a rewinder device 50, and a turn unit 60. When used as a simplex printer, only one of the press sections is used. When used as a duplex printer, the web press prints first on one side of the web media with the first press section 20 then turns the paper on the turn unit 60 and prints on the second side of the media with the second press section 22. Because the two press sections are positioned sequentially, the web press assembly has a relatively large footprint. Additionally, such digital presses are expensive, and having two presses for duplex printing can double the cost of such equipment.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
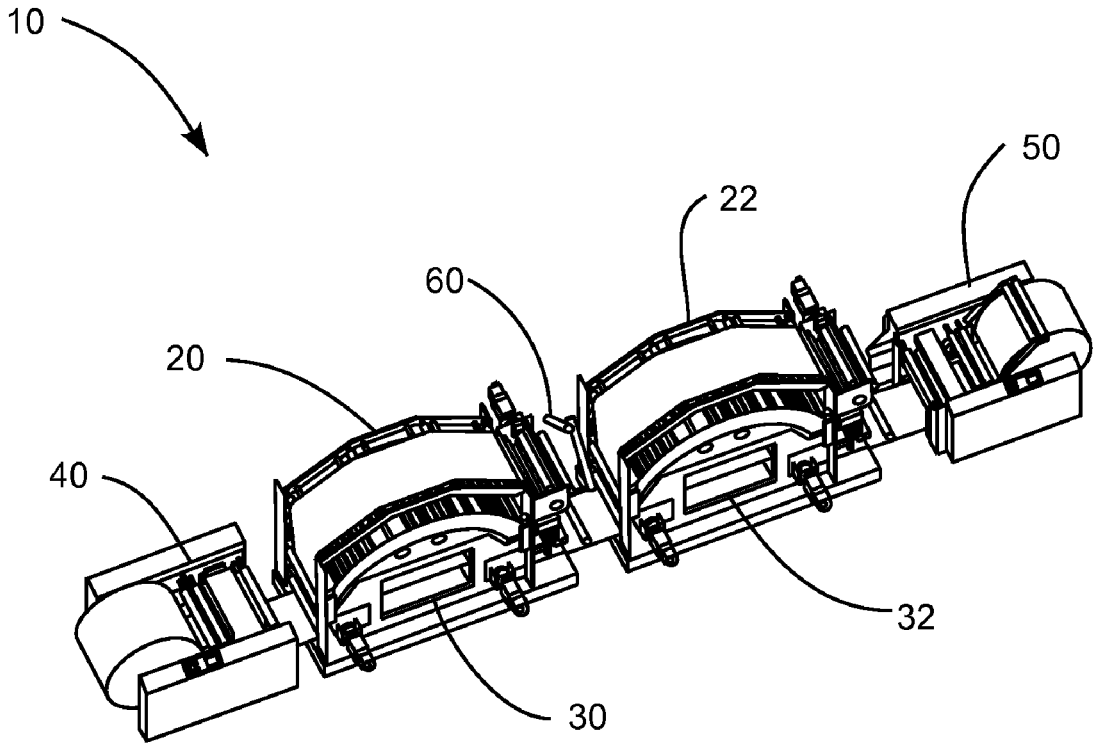
FIG. 1 (PRIOR ART)
FIG. 1 is a perspective view of a prior art digital web press.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

As used herein, directional terms, such as "top," "bottom," "front," "back," "leading," "trailing," etc, are used with reference to the orientation of the figures being described. Because components of various embodiments disclosed herein can be positioned in a number of different orientations, the directional terminology is used for illustrative purposes only, and is not intended to be limiting.

The exemplary embodiments described herein generally provide for a digital web press that can be configured to print on web media in simplex mode (single sided printing) and duplex mode (double sided printing). The digital web press can be an inkjet printing system, having a press section with a print head and a drying unit. A winder can be operatively coupled to the digital web press to feed web media into the press section from a roll of web media that can be unwound on a first core shaft of the winding unit. The web media can be passed through the print section for printing on a first side, turned over, and passed through the print section in an opposite direction for printing on a second side. The winder can then rewind the web media onto a roll on a second core shaft.

Figure 2:
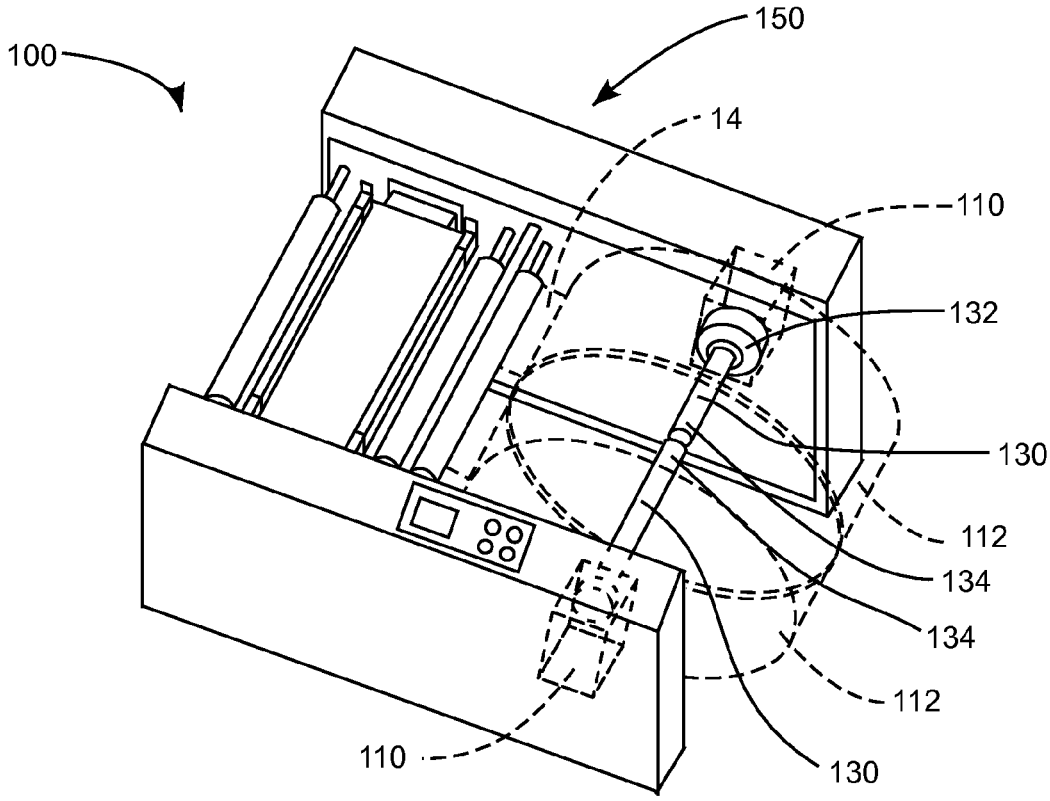
FIG. 2 is a perspective view of an embodiment of a dual web winder device in accordance with the present disclosure.
Figure 3:
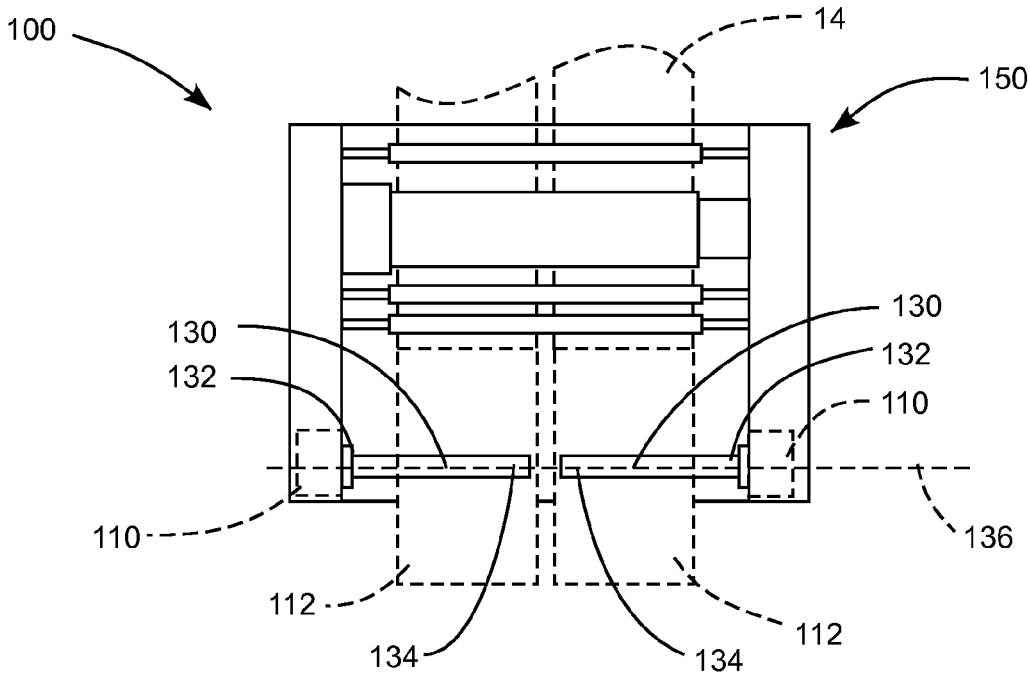
FIG. 3 is a top view of the dual web winder device of FIG. 2.

Provided in FIGS. 2-3 are perspective and top views of one embodiment of a dual web winder device, indicated generally at 100, for winding and unwinding web media for a web press. The dual web winder device can have a pair of drive motors, indicated generally at 110, and a pair of core shafts 130 operatively disposed in a frame, indicated generally at 150. Rolls of web media 112 can be placed on the core shafts for unwinding or rewinding web media 114, such as continuous rolls of paper, into the web press. The terms "core shaft" and "shaft" are used interchangeably herein to denote the shaft(s) upon which the media roll(s) is/are supported.

The pair of drive motors 110 are operatively coupled to the pair of core shafts 130. For example, each drive motor can be operatively coupled to one of the pair of core shafts to rotate the core shaft in an unwind or rewind direction for a roll of web media 112 placed upon the core shaft. Additionally, the drive motors can control the tension of the web media 114 on the web media rolls on the pair of core shafts.

Each of the pair of core shafts 130 can be configured to carry a different roll of web media 112. In the embodiment shown in FIGS. 2-3, each core shaft is sized to carry a roll of web media that has a width of approximately one half a width of the web press. The core shafts and drive motors 110 are synchronized to unwind a first roll of web media from one core shaft and simultaneously rewind a second roll of web media on the other core shaft. The dual web winder device can have the capability to synchronize speed, tension or neither for the two media rolls. The capability to synchronize speed or tension is desirable because the media web can expand or contract during its passage through the press section. This expansion or contraction can make it desirable for the rolls to be rewound at a variable speed or tension (relative to the other roll), depending on the control scheme that is chosen (i.e. speed or tension control). Web printers can be set up with motor/web control based on a constant tension or constant velocity, and the winder can be configured to match this control scheme. In addition, when ink is applied to the web, the web expands (through absorption of the liquid ink), and when the ink dries, the web contracts. To accommodate this expansion and contraction, the motors controlling the motion of the web downstream of the expansion/contraction are configured to either keep the tension or speed constant. Like many printing systems, the system disclosed herein can have a tension measurement system (not shown) in the web path, which monitors the tension of the web and provides feedback of this information to the system controller, allowing the motors to adjust to compensate for tension fluctuations. A speed measurement system (not shown) can also be used.

Additionally, the core shafts 130 are cantilever shafts with one end 132 supported by the frame 150, extending to an opposite free end 134. The core shafts can have substantially common axes of rotation, indicated by dashed line at 136, such that the free ends of each of the core shafts are positioned adjacent to one another. In this configuration the dual web winder device 100 can hold two rolls of web media 112 in an end to end relationship in a single winder device. Advantageously, holding two web media rolls in one winder device allows one winder to do the work of two, which reduces the overall footprint of the web press assembly associated with the dual web winder device.

Figure 4:
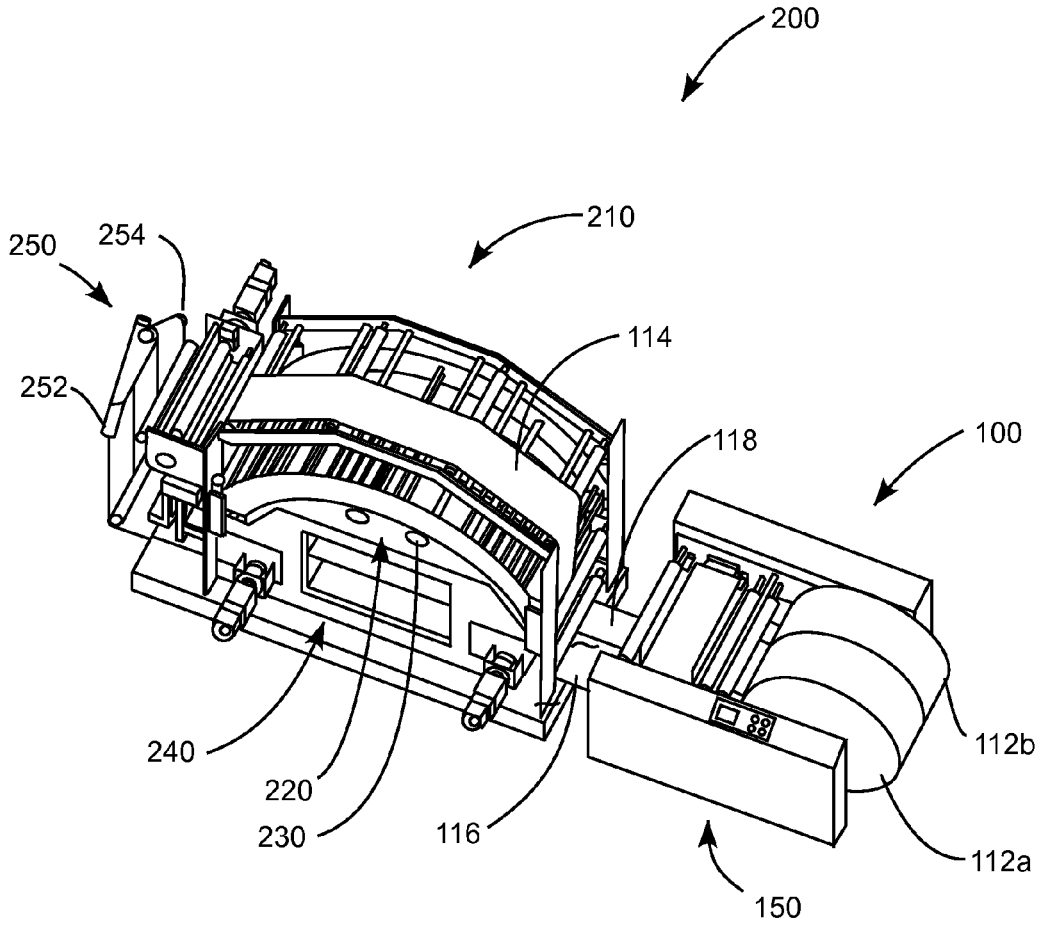
FIG. 4 is a perspective view of an embodiment of a digital web press in accordance with the present disclosure, shown with the dual web winder device of FIG. 2.
Figure 5:
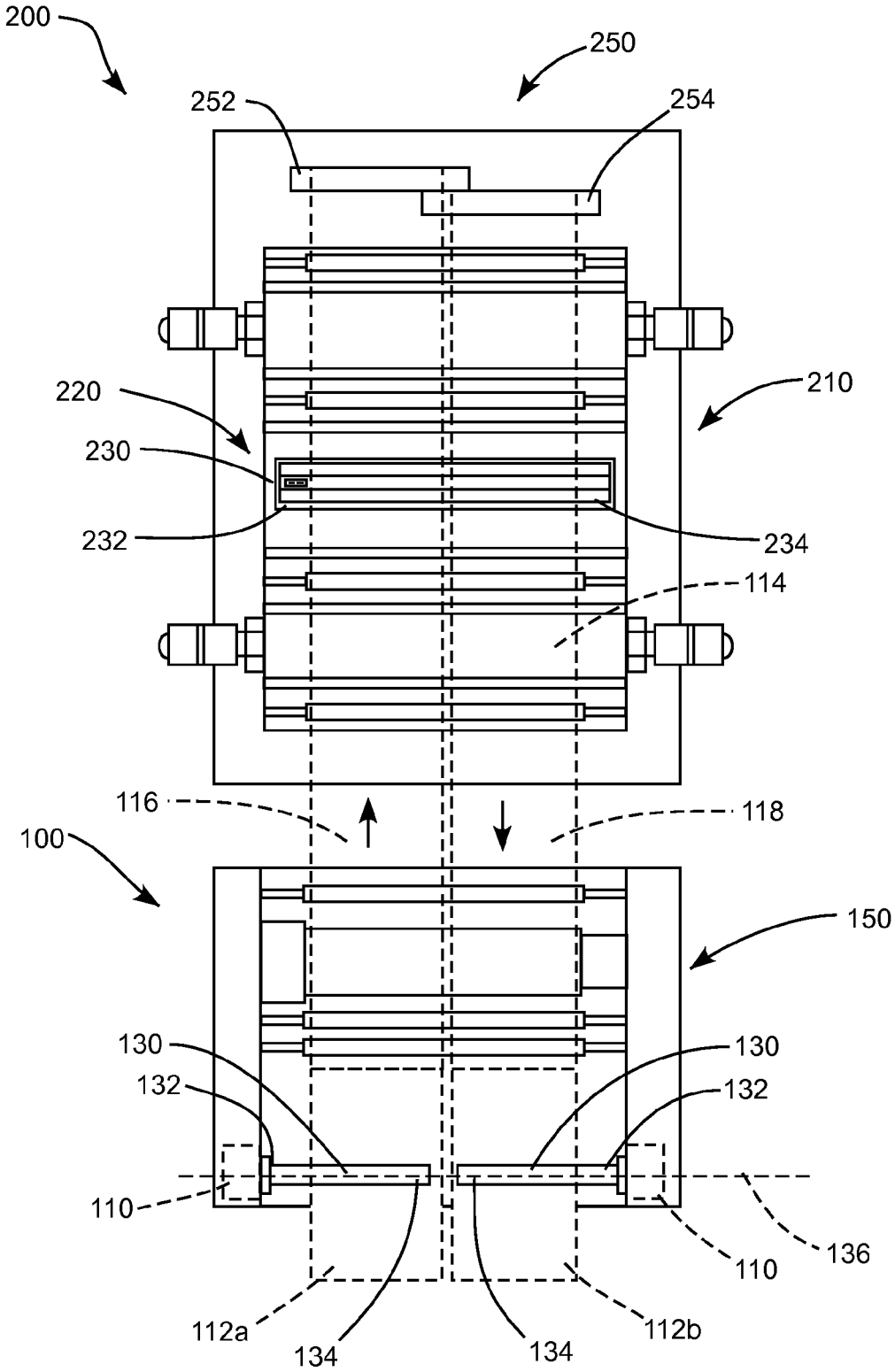
FIG. 5 is a top view of the digital web press of FIG. 4.

Provided in FIGS. 4-5 are perspective and top views of an embodiment of a thermal inkjet web press, indicated generally at 200, with the dual web winder device 100 described above and shown in FIGS. 2-3. The web press includes a press section, indicated generally at 210, for printing on the web media. The press section includes a print zone, indicated generally at 220, a dryer section, indicated generally at 240, and an inverter, indicated generally at 250, for turning the web media over to allow printing on both sides of the web media.

The print zone 220 includes one or more thermal inkjet print heads 230. Where monochrome (i.e. black) printing is to be performed, a single print head can be used. For color printing, multiple print heads are generally used, each print head ejecting ink of a different component color (e.g. cyan, magenta, yellow and black) to allow full color printing.

The thermal inkjet print heads have a predetermined width that can correspond to the width of the press section. The thermal inkjet print heads can be configured to print across the entire width of the print head with different portions of the print head width being controlled to print on different sides of the continuous web media 114. In this way, each thermal inkjet print head can be configured to print upon a first side 116 of the web media moving across a first portion 232 (FIG. 5) of the print head in one direction, and simultaneously to print upon a second side 118 of the web media moving across a second portion 234 (FIG. 5) of the print head in an opposite direction.

The dual web winder 100 is configured to unwind the continuous web media 114 from a first roll of web media 112*a* in order to feed the web media into the press section 210 where the web media can travel across the first portion 232 of the thermal inkjet print head 230. The dual web winder is also configured to receive the web media from the press section and to rewind the web media onto a second roll 112*b* as the web media exits the press section after passing below the second portion 234 of the thermal inkjet print head 234.

Referring to FIG. 5, the first roll of web media, or unwind roll 112*a*, can be placed on one of the pair of core shafts 130. The second roll of web media, or rewind roll 112*b*, can be placed on the other of the pair of core shafts. The core shafts can be synchronized with the pair of drive motors 110 to simultaneously unwind and rewind the first and second rolls of web media on the core shafts.

Because the core shafts 130 are sized to carry a roll of web media having a width of approximately one half a width of the thermal inkjet print head 230 of the web press 200, the web media 114 from the unwind roll 112*a* can pass across the first portion 232 of the thermal inkjet print head which can print on the first side 116 of the web media. The inverter 250 can then turn the web media over and feed the web media back into the press section 210 where the web media can pass across the second portion 234 of the thermal inkjet print head which can print on the second side 118 of the web media. The web media can then exit the press section and be rewound onto the rewind roll 112*b* on the dual web winder device 100.

Returning to FIGS. 4-5, the inverter 250 is operably coupled to the press section 210 to receive the web media 114 from the first portion 232 of the thermal inkjet print head 220 after printing on a first side 116 of the web media. The inverter has a pair of rollers 252 and 254 positioned at 45 degree angles with respect to one another, which turn the web media over to expose the second side 118 of the web media to the print head. The inverter then feeds the web media back into the press section and across the second portion 234 of the thermal inkjet print head with a second side available to the print head for printing.

Figure 6:
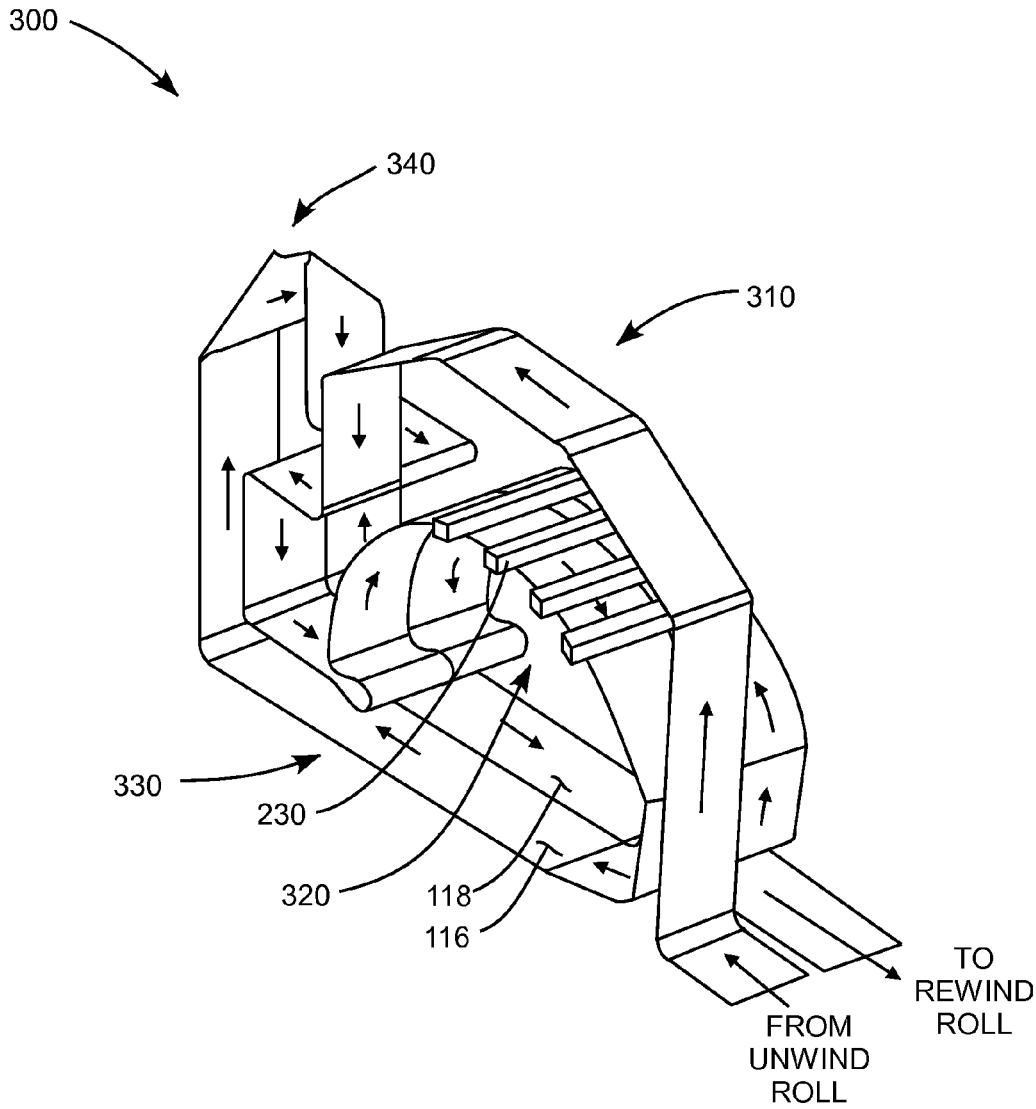
FIG. 6 is a schematic diagram of a travel path of web material traveling through the digital web press of FIG. 4.

FIG. 6 illustrates the travel path, indicated generally at 300, of the continuous web media 114 in FIGS. 4-5 as the web media travels from the unwind roll 112*a* of the dual winder device 100 to the web press section 210 and back to the rewind roll 112*b* of the dual web winder device. As shown in FIG. 6, the web media leaves the unwind roll and enters the web press section where the web media first passes through a staging section, indicated generally at 310 and then passes below the thermal inkjet print heads in the print zone 320 where the web media is printed on its first side 116. The web media then travels through the dryer section 330 where the ink is allowed to dry. The web media then travels to the inverter section 340 where the web media is turned over to expose the second side 118 of the web media for printing. The web media then returns to the print zone and again passes below the thermal inkjet print heads to print on the second side of the web media. The web media then passes through the dryer section again so that the ink on the second side of the web media can dry. The web media then returns to the dual web winder where the media is rewound on the rewind roll 112*b* (FIGS. 4-5).

It will be appreciated that unwinding and rewinding the web roll media on the dual winder device 100 disclosed herein minimizes the number of components that are involved to duplex print on digital web presses. For example, a separate rewinding unit is not needed on the opposite side of the web press to receive and rewind the web media that exits from the web press.

Additionally, by using a wider print head, the system cost is reduced as compared to the use of two smaller web presses. For example, a single 42 inch print head is typically less expensive than two 21 inch print heads. Moreover, for the system does not include two frames, two computers, two controllers and other dual structure for running a winder device in conjunction with a digital web press. Thus, the dual web winder device 100 reduces costs and minimizes the footprint space occupied by a digital web press operation.

Figure 7:
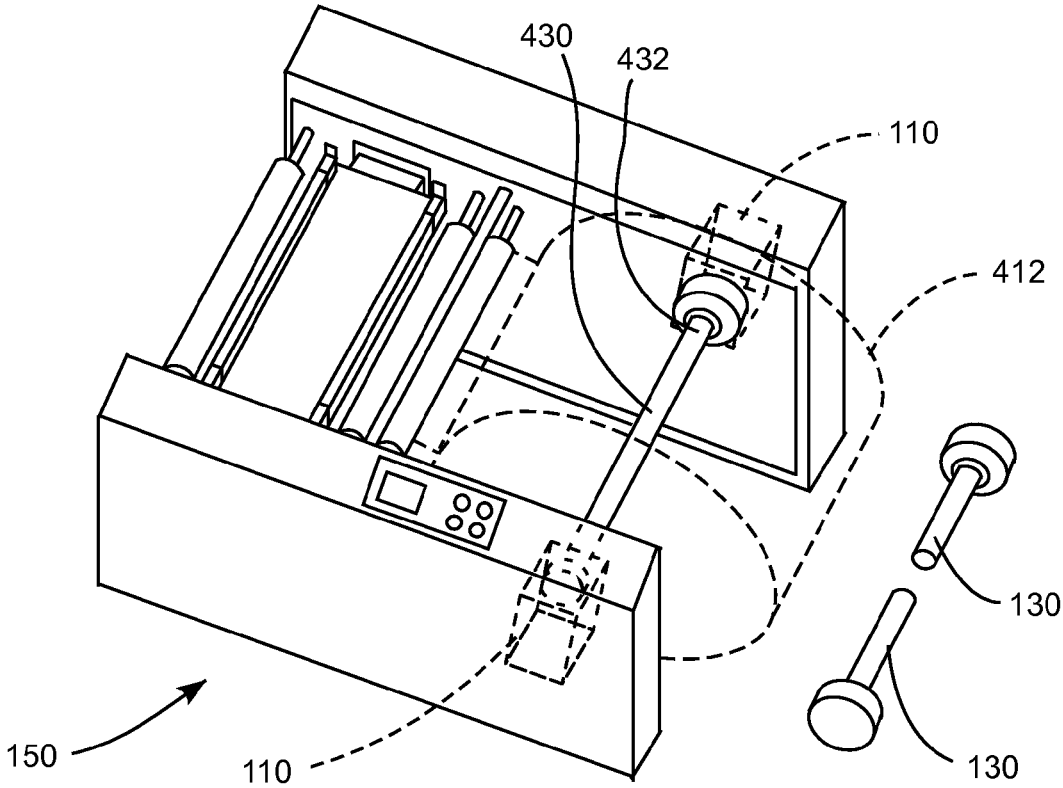
FIG. 7 is a perspective view of another embodiment of a dual web winder device in accordance with the present disclosure.
Figure 8:
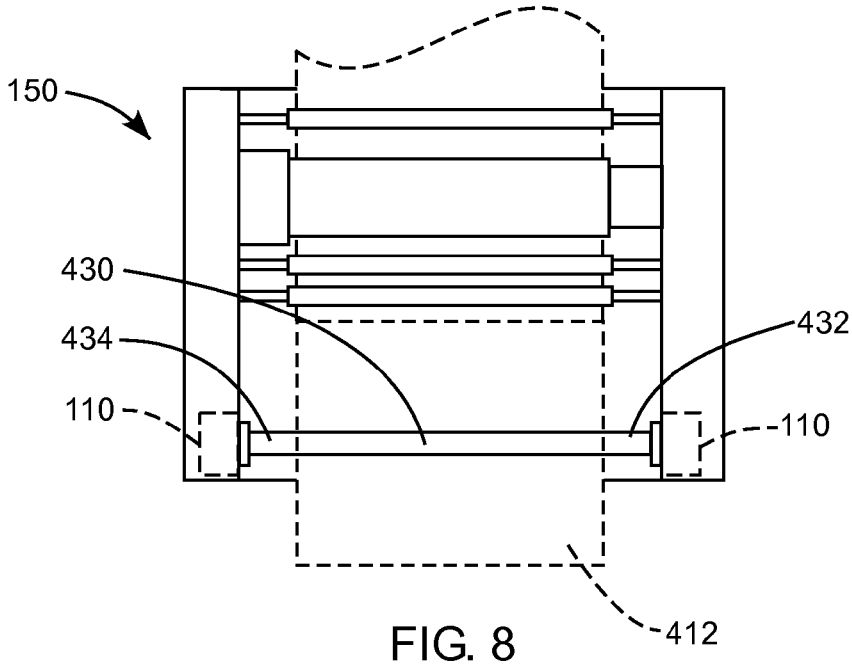
FIG. 8 is a top view of the dual web winder device of FIG. 8.

Provided in FIGS. 7-8 are perspective and top views of another embodiment of a dual web winder device, indicated generally at 400, for winding and/or unwinding web media for a web press. This dual web winder device is substantially similar to the dual web winder device 100 described above and shown in FIGS. 2-3. The dual web winder device 400 can have a pair of drive motors, indicated generally at 110, a pair of half-width core shafts, indicated generally at 130, and a full-width core shaft 430.

The half-width core shafts 130 have a width approximately one half the width of the web press, and are sized to carry rolls of web media 112 (FIG. 3) having a width approximately one half the width of the web press. This embodiment also includes a full-width core shaft 430, which has a width approximately the width of the web press, and is sized to carry a roll of web media 412 having a width approximately the full-width of the web press.

The pair of half-width core shafts 130 and the full-width core shaft 430 are interchangeably disposable in the frame 150. For example, the half-width core shafts can be disposed in the frame when half-width rolls of web media 112 are to be used in the web press, such as when the press will be used as a duplex press. The half-width core shafts can be removed and the full-width core shaft can be disposed in the frame when a full-width roll of web media 412 is to be used in the web press, such as when the web press will be used as a simplex printer.

The pair of drive motors 110 can be operatively coupled to the pair of half-width core shafts 130 when the half-width core shafts are disposed in the frame 150. In this case, each drive motor can be operatively coupled to one of the pair of half-width core shafts to independently rotate the half-width core shaft in an unwind or rewind direction for a roll of web 112 media placed upon the core shaft. Additionally, the drive motors can control the tension of the web media on the web media rolls on the pair of half-width core shafts.

Similarly, the pair of drive motors 110 can be operatively coupled to the single full-width core shaft 430 when the full-width core shaft is disposed in the frame 150. The pair of drive motors can be synchronized to simultaneously control the tension and rotation of the roll of web media on the full-width core shaft. It will also be appreciated that one of the pair of drive motors can be turned off when the single full-width core shaft is disposed in the frame, so that only one drive motor is used to control the tension and rotation of the core shaft.

When the pair of half-width core shafts 130 are disposed in the frame 150, each of the pair of core shafts can be configured to carry a different half-width roll of web media 112*a* and 112*b* (FIG. 4) that has a width of approximately one half the width of the web press. When the full-width core shaft 430 is disposed in the frame, the full-width core shaft can carry a single full-width roll of web media 412 that has a width approximately the full width of the web press.

Additionally, the half-width core shafts 130 are cantilever shafts with one end 132 supported by frame extending to an opposite end free 134 from support, while the full-width core shaft 430 is supported on both ends 432 and 434. Advantageously, supporting the full-width core shaft on both ends when a full-width roll of web media 412 is used provides sufficient support to carry the weight of a full-width roll of web media.

Figure 9:
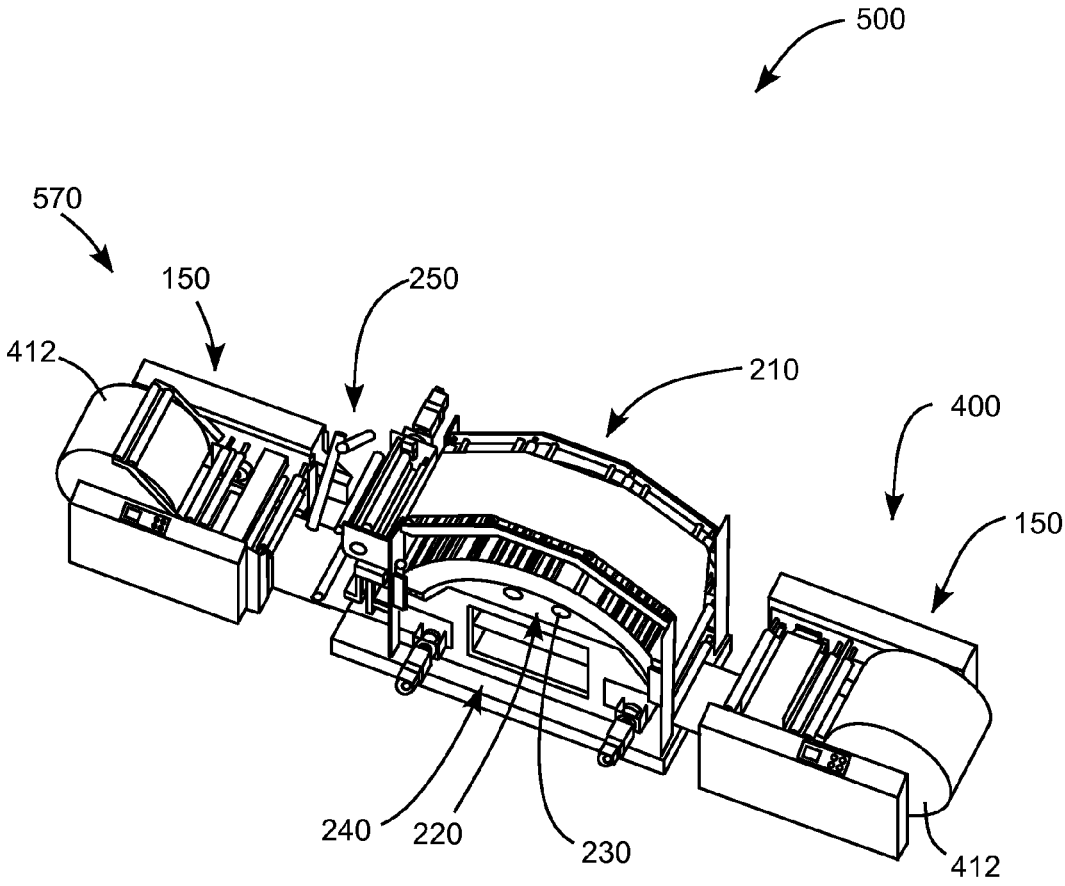
FIG. 9 is a perspective view of another embodiment of a digital web press in accordance with the present disclosure, shown with the dual web winder device of FIG. 7.
Figure 10:
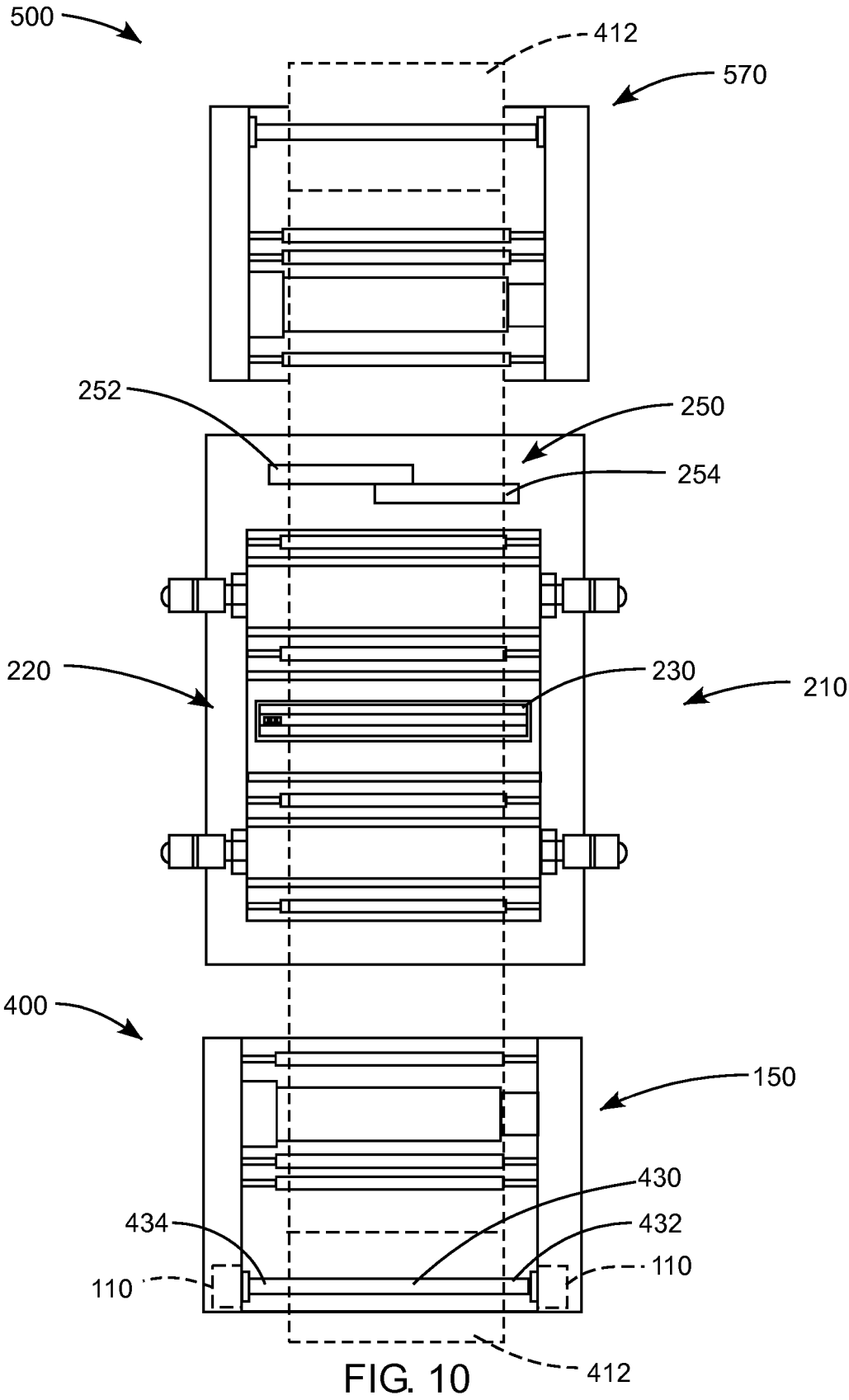
FIG. 10 is a top view of the digital web press of FIG. 9.

FIGS. 9-10 provide perspective and top views of another embodiment of a digital web press, indicated generally at 500, configured for simplex printing on full-width media. The digital web press can include the dual web winder device 400 described above and shown in FIGS. 7-8 and the press section 210 described above and shown in FIGS. 4-5.

The dual web winder 400 shown in FIGS. 9-10 is configured with a full-width core shaft 430 carrying a full-width roll of web media 412. The full-width roll of web media can be fed into the press section 210 for printing by the thermal inkjet print head(s) 230.

The web press 500 can also include a rewind unit, indicated generally at 570, that can be positioned on an opposite end of the web press from the dual web winder 400. The rewind unit 570 can receive and rewind the full-width web media 412 from the press section 210.

Figure 11:
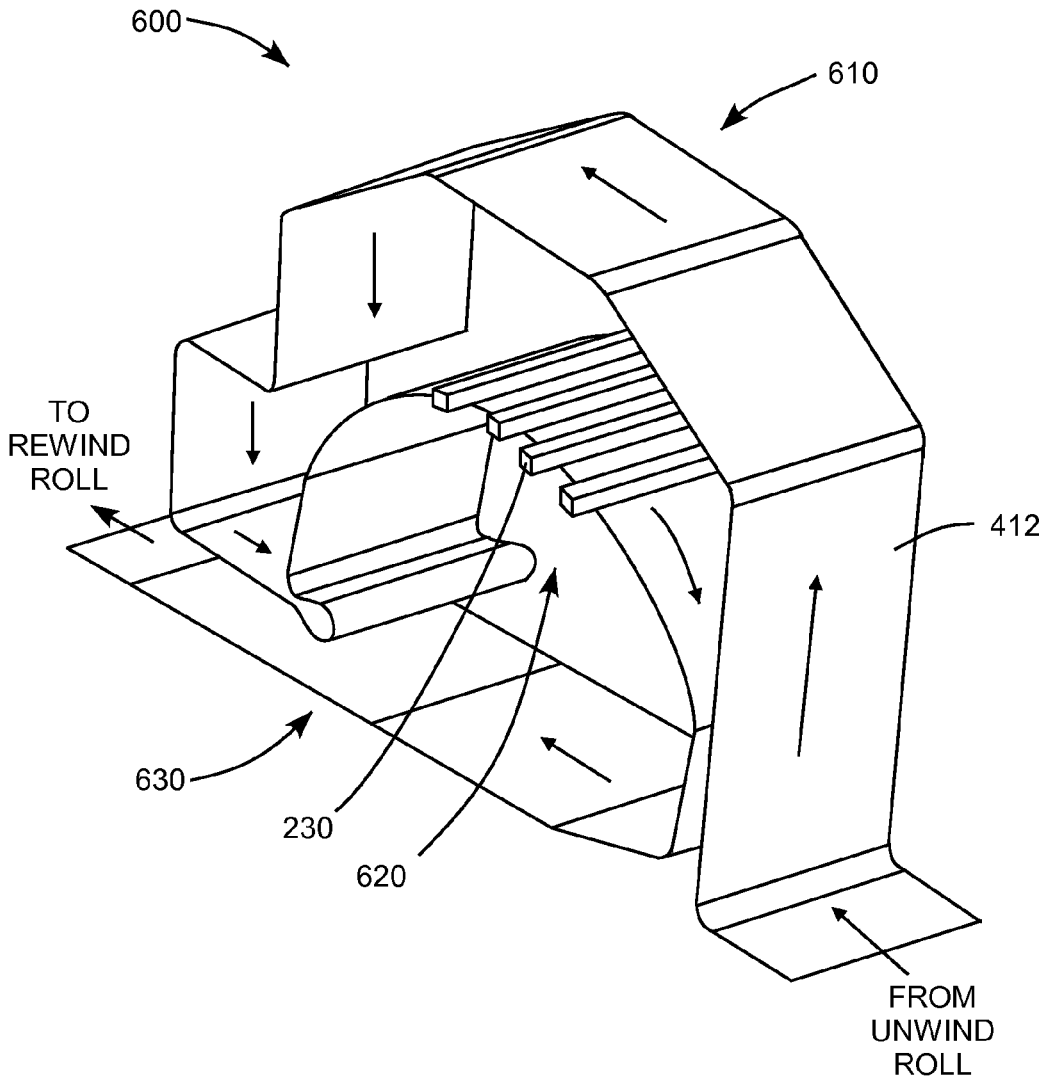
FIG. 11 is a schematic diagram of a travel path of web material traveling through the digital web press of FIG. 9.

FIG. 11 illustrates the travel path of the continuous full-width web media, indicated generally at 600 as it travels from the unwind roll of the dual winder device through the web press and to the rewind unit. As the full-width web media 412 leaves the unwind roll and enters the web press the web media first passes through a staging section, indicated generally at 610, and then crosses the thermal inkjet print head in the print zone, indicated generally at 620, where the print heads print on the full-width web media. The full-width web media then travels through the dryer section, indicated generally at 630, where the ink is allowed to dry. The web media then travels to the rewind unit (570 in FIGS. 9, 10) where the full-width web media is rewound on a rewind roll.

Although not shown in FIGS. 9-10, it will be appreciated that the dual web winder 400 can also be configured with the two half-width core shafts 130 to unwind and rewind a roll of half-width web media 112 for duplex printing on half-width media. When configured in this way, the half-width web media can be turned on the inverter 250 and fed back through the press section 210 and to the dual web winder device 400, similar to the web press 200 described above and shown in FIGS. 4-5. In this way, the web press 500 can be used either as a simplex press for full-width web media 430, as shown in FIGS. 9 and 10, or as a duplex press for half-width web media, as shown in FIGS. 4-5.

Figure 12:
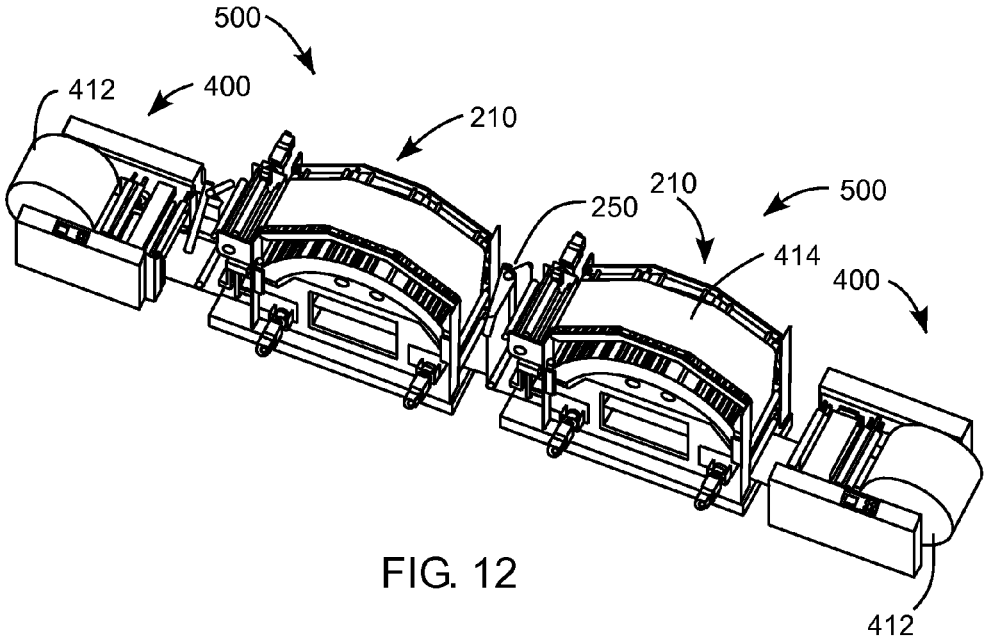
FIG. 12 is a perspective view of the digital web press of FIG. 9, shown positioned in sequence with a second digital web press of FIG. 9, and shown with a roll of full-width web media.

As shown in FIG. 12, the web press 500 and dual web winder 400 can be placed sequentially in series with another web press and dual web winder in order to accommodate duplex printing on full-width web media 414. When placed in this configuration, an inverter 250 can be placed between the press sections 210 in order to invert the web media to make a second side available for printing in the second press section.

Figure 13:
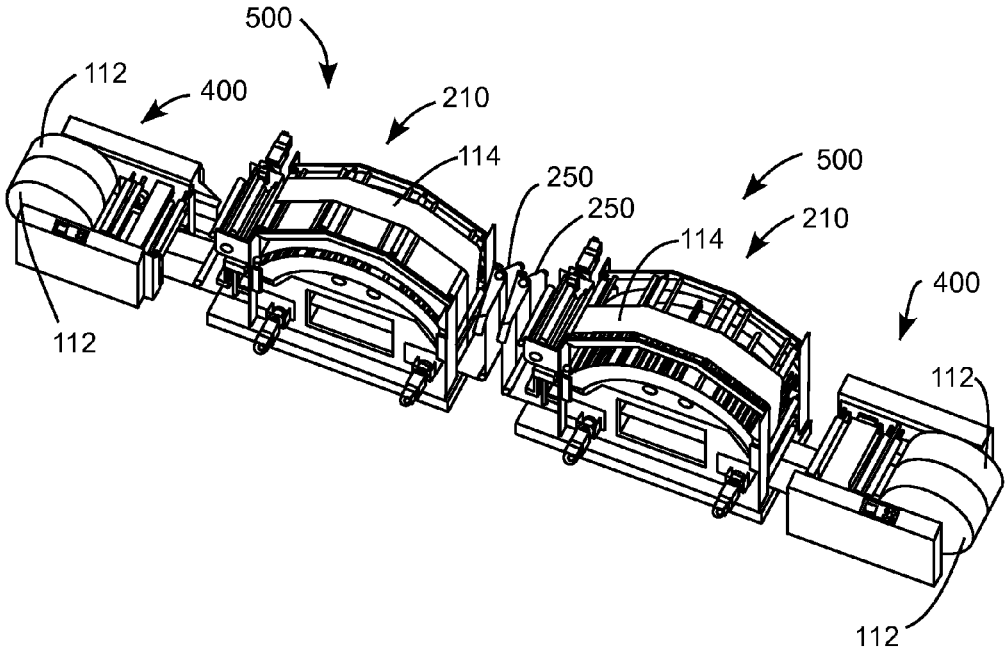
FIG. 13 is a perspective view the digital web press of FIG. 9, shown positioned in sequence with a second similar digital web press, and shown with rolls of half-width web media.

Additionally, as shown in FIG. 13, each of the web presses 500 in the sequential or tandem arrangement can have a dual web winder 400 configured to handle rolls of half-width web media 112. In this configuration each web press 500 can be used as duplex web presses for printing on half-width web media 114. When used with half-width web media, two inverters 250 can be placed between the press sections 210 so that the half-width web media from each press section can be turned over for printing on the second side.

In this way, the embodiments of the dual web winders 100 and 400 described herein can greatly increase the versatility and usability of the digital web presses 200 and 500 by allowing simplex or duplex printing of both full- and half-width web media.

Figure 14:
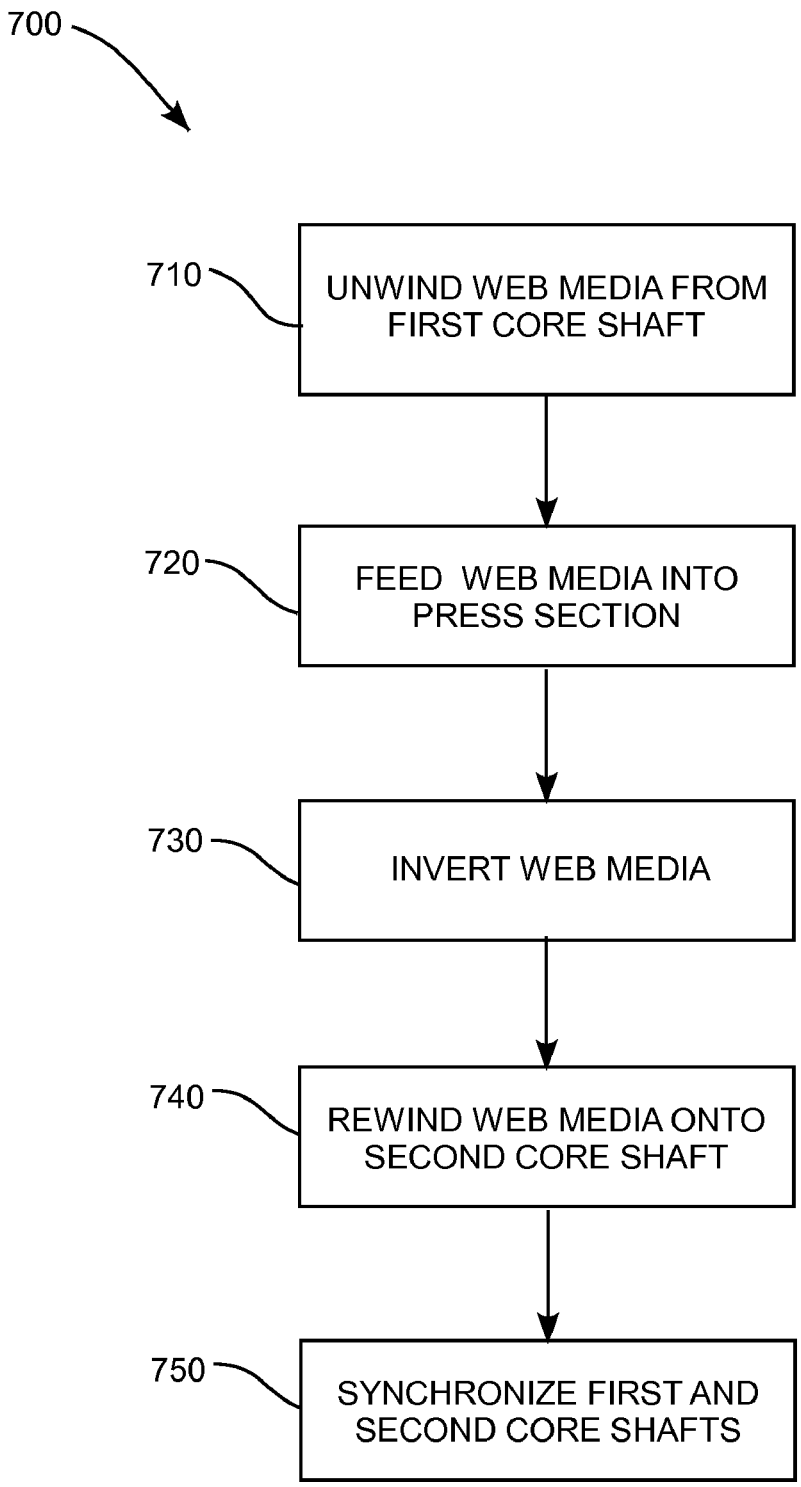
FIG. 14 is a flow chart outlining the steps in one embodiment of a method for printing on two sides of continuous web media in a thermal inkjet web press.

Provided in FIG. 14 is a flow chart outlining the steps in one embodiment of a method for printing on two sides of continuous web media in a thermal inkjet web press. The method, indicated generally at 700 includes unwinding the web media from a first roll rotatably disposed on a first core shaft of a dual web winder, as indicated at 710. The web media is fed into a press section of the web press in a first direction and printed upon a first side of the web media, as indicated at 720. The web media is inverted and fed to the press section in a second direction and printed upon a second side of the web media, as indicated at 730. The web media is then rewound onto a second roll rotatably disposed on a second core shaft of the dual web winder, as indicated at 740.

The method can also include synchronizing rotation of the first and second core shafts and the pair of motors to simultaneously unwind the web media from the first core shaft and rewind the web media upon the second core shaft, as shown at 750. Each drive motor can be operatively coupled to one of the first and second core shafts to unwind and rewind the roll of web media from the first core shaft to the second core shaft or vice versa.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A dual web winder device for a web press, comprising:

a) a pair of drive motors;

b) a pair of shafts, each coupled to a different drive motor, and configured to carry a roll of web media;

c) the shafts and drive motors being synchronized to simultaneously unwind a first roll of web media from one shaft and rewind a second roll of web media on the other shaft; and d) an inverter to receive the web media from the one shaft, to turn the web media over, and to feed the web media to the other shaft.

2. A device in accordance with claim 1, wherein the shafts are sized to carry a roll of web media having a width of approximately one half a width of the web press.

3. A device in accordance with claim 1, wherein the shafts are cantilever shafts.

4. A device in accordance with claim 1, wherein the shafts have substantially common axes of rotation.

5. A device in accordance with claim 1, wherein the shafts are removable, and further comprising:

a full-width shaft, positionable in place of the pair of shafts, having a width approximately equal to a width of the web press, the full-width shaft being sized to carry a roll of web media having a width approximately the full width of the web press.

6. A thermal inkjet digital web press, comprising:

a) a press section, having a thermal inkjet print head, configured to simultaneously print upon first and second sides of a continuous web of media moving through the press section in opposite directions; and b) a dual web winder, configured to unwind the web from a first roll to feed the press section, and to rewind the web onto a second roll as the web exits the press section.

7. A press in accordance with claim 6, the dual web winder further comprising:

a) a pair of drive motors;

b) a pair of shafts, each coupled to one of the drive motors and configured to carry a roll of web media; and c) the shafts and drive motors being synchronized to simultaneously unwind a first roll of web media from one shaft and rewind a second roll of web media on the other shaft.

8. A press in accordance with claim 7, wherein the shafts are sized to carry a roll of web media having a width of approximately one half a width of the web press.

9. A press in accordance with claim 7, wherein the shafts are cantilever shafts.

10. A press in accordance with claim 7, wherein the shafts have substantially common axes of rotation.

11. A press in accordance with claim 6, further comprising:

an inverter, operably coupled to the press section to receive web media from a first portion of the thermal inkjet print head after printing on the first side of the web media, to invert the web media, and to feed the web media back into a second portion of the thermal inkjet print head with the second side available to the print head for printing.

12. A method for printing on two sides of continuous web media in a thermal inkjet web press, comprising the steps of:

a) unwinding the web media from a first roil rotatably disposed on a first shaft of a dual web winder;

b) feeding the web media into a press section of the web press in a first direction and printing upon a first side of the web media;

c) inverting the web media and feeding the web media to the press section in a second direction and printing upon a second side of the web media; and d) rewinding the web media onto a second roll rotatably disposed on a second shaft of the dual web winder.

13. A method in accordance with claim 12, further comprising the step of:

e) synchronizing rotation of the first and second shafts to unwind the web media from the first shaft and rewind the web media upon the second shaft.

14. A method in accordance with claim 12, wherein the first and second shafts are cantilever shafts sized to carry a roll of web media having a width of approximately one half a width of the thermal inkjet web press.

15. A method in accordance with claim 14, further comprising the step of:

f) replacing the first and second shafts of the dual web winder with a third shaft sized to carry a roll of web media having a width approximately equal to a width of the thermal inkjet web press, thereby converting the web press to print on one side of full-width media.

* * * * *

UNITED STATES PATENT AND TRADEMARK OFFICE

CERTIFICATE OF CORRECTION

PATENT NO. : 8,240,843 B2
APPLICATION NO. : 12/404537
DATED : August 14, 2012
INVENTOR(S) : Paul Ray It is certified that error appears in the above-identified patent and that said Letters Patent is hereby corrected as shown below:

In column 8, line 24, in Claim 12, delete "roil" and insert -- roll --, therefor.

Signed and Sealed this
Twenty-sixth Day of February, 2013

Teresa Stanek Rea
*Acting Director of the United States Patent and Trademark Office*